US009166307B2

(12) United States Patent
Shaw

(10) Patent No.: US 9,166,307 B2
(45) Date of Patent: Oct. 20, 2015

(54) ENHANCED CONTINUITY COAXIAL CONNECTORS WITH SOCKETED NUT

(71) Applicant: PerfectVision Manufacturing, Inc., Little Rock, AR (US)

(72) Inventor: Glen David Shaw, Conway, AR (US)

(73) Assignee: PerfectVision Manufacturing, Inc., Little Rock, AR (US)

( * ) Notice: Subject to any disclaimer, the term of this patent is extended or adjusted under 35 U.S.C. 154(b) by 36 days.

(21) Appl. No.: 14/216,009

(22) Filed: Mar. 17, 2014

(65) Prior Publication Data

US 2014/0273621 A1 Sep. 18, 2014

Related U.S. Application Data

(60) Provisional application No. 61/788,168, filed on Mar. 15, 2013.

(51) Int. Cl.
*H01R 9/05* (2006.01)

(52) U.S. Cl.
CPC ..... *H01R 9/0524* (2013.01)

(58) Field of Classification Search
CPC ..... H01R 9/05; H01R 9/0524; H01R 9/0521; H01R 9/0518; H01R 9/0527; H01R 13/65802; H01R 9/0515
See application file for complete search history.

(56) References Cited

U.S. PATENT DOCUMENTS

| | | | | |
|---|---|---|---|---|
| 6,817,896 | B2 * | 11/2004 | Derenthal | 439/578 |
| 7,097,499 | B1 * | 8/2006 | Purdy | 439/578 |
| 7,892,024 | B1 * | 2/2011 | Chen | 439/578 |
| 8,834,200 | B2 * | 9/2014 | Shaw | 439/578 |

* cited by examiner

*Primary Examiner* — Xuong Chung Trans
(74) *Attorney, Agent, or Firm* — Stephen D. Carver; Robert E. Fahr, Jr.

(57) ABSTRACT

An axially compressible F-connector for conventional installation tools for interconnection with coaxial cable includes a rigid nut with a rear skirt forming a socket. A rigid, tubular post penetrates the nut and engages coaxial cable. An internal, slidable sleeve has a plug portion that is adapted to engage and seat within the socket. A tubular end cap completes the assembly. The tubular post coaxially extends through the connector, physically connecting the nut and coaxial cable it engages. However, grounding is insured by portions of the cable sheath that are sandwiched within the socket between the sleeve plug and the nut skirt by sealing O-rings affixed to the sleeve plug.

15 Claims, 8 Drawing Sheets

ENHANCED CONTINUITY COAXIAL CONNECTORS WITH SOCKETED NUT

PRIORITY AND INCORPORATION BY REFERENCE

This application is based upon, and claims priority from, U.S. Provisional Patent App. No. 61/788,168 filed Mar. 15, 2013, entitled "Enhanced Continuity Coaxial Connectors with Socketed Nut" by inventor Glen David Shaw, which is incorporated herein by reference in its entirety and for all purposes.

This application incorporates by reference U.S. Pat. No. 7,841,896 B1 which issued from U.S. patent application Ser. No. 12/380,327 filed Feb. 26, 2009, U.S. Pat. No. 7,513,795 which issued from U.S. patent application Ser. No. 12/002,261 filed Dec. 17, 2007, and U.S. Pat. No. 8,371,874 which issued from U.S. patent application Ser. No. 12/927,424 filed Nov. 15, 2010.

BACKGROUND OF THE INVENTION

1. Field of Invention

The present invention relates generally to coaxial cable connectors, particularly F-connectors, that are designed to establish fail-safe grounding. More particularly, the present invention relates to coaxial F-connectors that establish enhanced grounding during installation through direct, internally crimpled contact with the coaxial cable sheath. Known prior art can be found within numerous subclasses of United States Patent Class 439, including subclasses 241, 247, 322, 548, 553, 554, 578, 583, 585, 587 and others.

2. Discussion of the Related Art

Popular cable television systems and satellite television receiving systems depend upon coaxial cable for distributing signals. As is known in the satellite TV arts, coaxial cable in such installations is terminated by F-connectors that threadably establish the necessary signal wiring connections. The F-connector forms a "male" connection portion that fits to a variety of receptacles, forming the "female" portion of the connection.

Typical F-connectors include a tubular post designed to slide over coaxial cable dielectric material and under the outer, conductive sheath at the prepared end of the coaxial cable. The exposed, conductive sheath is usually folded back over the cable jacket. The cable jacket and folded-back outer conductor extend generally around the outside of the tubular post and are typically coaxially received within the tubular connector. A continuity contact between the sheath and electrically conductive portions of the connector is needed. Moreover, electrical contact must be made with the F-connector threaded nut that contacts the female socket to which the connection is made. Stated another way, a fundamental goal with modern F-connectors is to establish a fail safe continuity path between the coaxial cable outer sheath, that makes contact within the F-connector, and the target socket to which the connector is threadably coupled, that makes contact with the connector exterior.

F-connectors have numerous advantages over other known fittings, such as RCA, BNC, and PL-259 connectors, in that no soldering is needed for installation, and costs are reduced as parts are minimized. For example, with an F-connector, the center conductor of a properly prepared coaxial cable fitted to it forms the "male" portion of the receptacle connection, and no separate part is needed. A wide variety of F-connectors are known in the art, including the popular compression type connector that aids in rapid assembly and installation. Hundreds of such connectors are seen in U.S. Patent Class 439, particularly Subclass 548.

However, the extremely high bandwidths and frequencies distributed in conjunction with modern satellite installations necessitates a variety of strict quality control factors. For example, the electrical connection established by the F-connector must not add electrical resistance to the circuit. The F-connector must exhibit a proper surge impedance to maintain a wide bandwidth, in the order of several Gigahertzes. Numerous physical design requirements exist as well. For example, connectors must establish and maintain a proper moisture seal against the environment, and they must function over long time periods through extreme weather and temperature conditions. Requirements exist governing frictional insertion and disconnection or withdrawal forces as well.

The establishment of proper electrical continuity is a paramount requirement. Low resistance electrical continuity throughout the connector contributes to proper grounding and shielding in use. Within the connector, it is important to establish effective electrical continuity between the F-connector nut and the internal, coaxial cable sheath. One facet of the problem involves the establishment of electrical continuity between the F-connector nut and the internal post. With most known F-connector designs, the coaxial cable sheath electrically contacts the shank of the internal post within the connector. Thus it is important that the F-nut and the internal post within the connector establish electrical contact with one another. With proper electrical contact between the nut and the post established, a dependable electrical connection between the F-connector nut and the coaxial cable sheath results via a multi-step process. Thus proper grounding is established with the target socket to which the connector is ultimately fitted.

Proper installation techniques require adequate torquing of the connector's F-nut. In other words, it is desired that the installer appropriately tighten the F-nut during installation to establish a dependable electrical grounding path between the connector body, the coaxial cable sheath, and the target socket. Threaded F-connector nuts should be installed with a wrench to establish reasonable torque settings. Proper tightening of the F-nut to the threaded female socket applies pressure to the inner conductor of the coaxial cable to establish proper connections within the socket. Further, proper torquing insures mechanical and electrical contact between the F-nut and the internal post. With many F-connector designs, proper tightening insures that portions of the tubular post directly engage outer conductive portions of the appliance port, thereby making a direct electrical ground connection between the outer conductor of the appliance port and the tubular post. Of course the tubular post is electrically in contact with the outer conductor or sheath of the coaxial cable, so a ground connection is established between the cable and the target port or socket.

Many connector installations, however, are not properly completed. It is a simple fact in the satellite and cable television industries that many F-connectors are not appropriately tightened by the installer. The common installation technique is to torque the F-connector with a small wrench during installation. In some cases installers only partially tighten the F-connector. Some installations are only hand-tightened. Furthermore, many installations are subject to repetitive disconnection and reconnection by the end user or customer. For example, in geographic locations subject to frequent high intensity lightning storms, it is prudent to disconnect internal household connections to major appliances during storms to prevent damage or even destruction from lightning. Afterwards, the connections are reestablished, usually only by hand tightening, and problems related to insufficient grounding appear.

As a consequence of insufficient connector tightening, degraded electrical continuity can occur. When F-connectors are not properly "grounded," the electrical continuity is compromised. An appropriate low resistance, low loss connection to the female target socket, and the equipment connected to it, will not be established. Unless a proper ground path is established, poor signal quality, and RFI leakage, will result. This translates to signal loss or degradation to the customer.

U.S. Pat. No. 3,678,445 issued Jul. 18, 1972 discloses a shield for eliminating electromagnetic interference in an electrical connector. A conductive shielding member having a spring portion snaps into a groove for removably securing the shield. A second spring portion is yieldable to provide electrical contact between the first shell member and a second movable shell member.

U.S. Pat. No. 3,835,443 issued Sep. 10, 1974 also discloses an electromagnetic interference shield for a connector. A helically coiled conductive spring is interposed between mating halves of the connector. The coiled spring has convolutions slanted at an oblique angle to the center axis of the connector. Mating of the connector members axially flattens the spring to form an almost continuous metal shield between the connector members.

U.S. Pat. No. 3,739,076 issued Jun. 12, 1973 discloses a coaxial connector with an internal, electrically conductive coil spring mounted between adjacent portions of the connector. As an end member is rotatably threaded toward the housing, an inwardly directed, annular bevel engages the spring and moves it towards an electrically shielded portion of the cable. The spring is compressed circumferentially, so that its inner periphery makes electrical grounding contact with the shielded portion of the cable.

U.S. Pat. No. 4,106,839 issued Aug. 15, 1978 shows a coaxial connector with a resilient, annular insert between abutting connector pieces for grounding adjacent parts. A band having a cylindrical surface is seated against an internal surface. Folded, resilient fingers connected with the band are biased into contact. The shield has a plurality of folded integral, resilient fingers for establishing a ground.

U.S. Pat. No. 4,423,919 issued Jan. 3, 1984 discloses a connector with having a cylindrical shell with a radial flange, a longitudinal key, and a shielding ring fitted over the shell adjacent the flange. The shielding ring comprises a detent having end faces configured to abut connector portions when the detent fits within the keyway, whereby the shell is prevented from rotating.

U.S. Pat. No. 4,330,166 issued May 18, 1982 discloses an electrical connector substantially shielded against EMP and EMI energy with an internal, conductive spring washer seated in the plug portion of the connector. A wave washer made from beryllium copper alloy is preferred.

U.S. Pat. No. 5,066,248 issued Nov. 19, 1991 discloses a coaxial cable connector comprising a housing sleeve, a connector body, a locking ring, and a center post. A stepped annular collar on the connector body ensures metal-to-metal contact and grounding.

U.S. Pat. No. 6,332,815 issued Dec. 25, 2001 and U.S. Pat. No. 6,406,330 issued Jun. 18, 2002 utilize clip rings made of resilient, conductive material such as beryllium copper for grounding. The clip ring forms a ground between a male member and a female member of the connector.

U.S. Pat. No. 6,406,330 issued Jun. 18, 2002 employs an internal, beryllium copper clip ring for grounding. The clip ring forms a ground circuit between a male member and a female member of the electrical connector. The clip ring includes an annular body having an inner wall and an outer wall comprising a plurality of circumferentially spaced slots.

U.S. Pat. No. 6,716,062 issued Apr. 6, 2004 discloses a coaxial cable F connector with an internal coiled spring that establishes continuity. The spring biases the nut towards a rest position wherein not more than three revolutions of the nut are necessary to bring the post of the connector into contact.

U.S. Pat. No. 7,114,990 issued Oct. 3, 2006 discloses a coaxial cable connector with an internal grounding clip establishing a grounding path between an internal tubular post and the connector. The grounding clip comprises a C-shaped metal clip with an arcuate curvature that is non-circular. U.S. Pat. No. 7,479,035 issued Jan. 20, 2009 shows a similar F-connector grounding arrangement.

U.S. Pat. No. 7,524,216 issued Nov. 2, 2010 discloses a coaxial connector comprising a body, a post including a flange having a tapered surface, a nut having an internal lip with a tapered surface, wherein the tapered surface of the nut oppositely corresponds to the tapered surface of the post when it is assembled. A conductive O-ring between the post and the nut establishes continuity.

U.S. Pat. No. 7,845,976 issued Dec. 7, 2010 and U.S. Pat. No. 7,892,005 issued Feb. 22, 2011 use conductive, internal O-rings for both grounding and sealing.

U.S. Pat. No. 7,753,705 issued Jul. 13, 2010 discloses an RF seal for coaxial connectors. The seal comprises a flexible brim, a transition band, and a tubular insert with an insert chamber defined within the seal. In a first embodiment the flexible brim is angled away from the insert chamber, and in a second embodiment the flexible brim is angled inward toward the insert chamber. A flange end of the seal makes a compliant contact between the port and connector faces when the nut of a connector is partially tightened, and becomes sandwiched firmly between the ground surfaces when the nut is properly tightened.

U.S. Pat. No. 7,824,216 issued Nov. 2, 2010 discloses a coaxial connector comprising a body, a post including a flange having a tapered surface, a nut having an internal lip with a tapered surface which oppositely corresponds to the tapered surface of the post when assembled, and a conductive O-ring between the post and the nut for grounding or continuity.

U.S. Pat. No. 7,841,896 issued Nov. 30, 2010, and entitled "Sealed compression type coaxial cable F-connectors", discloses axially compressible, high bandwidth F-connectors for interconnection with coaxial cable. An internal, dual segment sealing grommet activated by compression provides a seal. Each connector nut interacts with a tubular body and a rigid, conductive post coaxially extending through the connector. A post barbed end penetrates the cable within the connector. A metallic end cap is slidably fitted to the body. A tactile system comprising external convex projections on the body complemented by a resilient, external O-ring on the end cap aids installers who can properly position connectors with the sense of touch.

Similar U.S. Pat. No. 7,845,976 issued Dec. 7, 2010 and U.S. Pat. No. 7,892,005 issued Feb. 22, 2011 use conductive, internal O-rings for both grounding and sealing.

U.S. Pat. No. 7,892,024 issued Feb. 22, 2011 shows another grounding insert for enhancing F-connector continuity.

Structural improvements to compressible F-connectors for enhancing continuity or grounding must function reliably without degrading other important connector requirements. For example, compressible connectors must adequately compress during installation without excessive force, and without bending or deforming. An environmental seal must be established to keep out water or other contaminants. The coaxial cable inserted into the connector must not be mechanically broken or short circuited. Field installers and technicians must be satisfied with the ease of installation. Finally, the bottom line is that a long lived, reliable installation must result for customer satisfaction.

Electrical continuity in connectors has previously been accomplished by manufacturing all or a majority of the components of connectors from conductive materials such as copper or copper plated metals. Metal components are typically more expensive to manufacture and transport than non-conductive alternatives such as plastic components. However, it is the non-conductive property of plastics that has limited it use in prior-art connectors.

As implied from the above-discussed art, many prior art attempts at enhanced grounding exist. Several solutions involve the addition of auxiliary conductive grounding structures within the fitting. These can physically bear against critical parts or extend between them to enhance continuity. For example, several prior design approaches include structure that forcibly urges the internal connector post into pressured contact with the F-nut. Some designs include auxiliary internal structures that provide additional electrical connection paths between the F-nut and the post, and some such structures may include portions that contact the socket to which the fitting is attached. In most of these designs the coaxial cable sheath is connected to the structure by physical contact with the post, which in turn touches the F-nut. However, recent experience suggests that better continuity can be established by additionally urging portions of the conductive cable sheath into direct mechanical and electrical contact with portions of the F-nut. In other words, it is desirable to enhance electrical continuity by directly contacting the F-nut with the cable sheath, minimizing the connector components involved in the electrical connection path.

SUMMARY OF THE INVENTION

The compressible F-connector described herein comprises a rigid nut with a faceted drive head at its front that is torqued during fitting installation. The head has an internally threaded, tubular stem, for threadably mating with a conventional F-type female receptacle. However, the F-nut includes an integral, trailing skirt that defines an open socket. An elongated, internal post coupled to the nut includes a shank, which can be barbed or barbless, that engages the prepared end of a coaxial cable. The properly prepared coaxial cable end includes a leading, terminal end of exposed sheath that is folded or flared radially outwardly.

During compression the post shank is coaxially positioned between the cable sheath and portions of the cable inner dielectric plastic. A hollow, generally tubular sleeve disposed within the fitting is coaxially coupled to the post. The sleeve has a leading plug end over which at least a portion of the exposed, terminal of the sheath is folded. When the fitting is compressed, the sleeve is forced towards the F-nut, and the sleeve plug is seated within the F-nut socket, with a portion of the exposed sheath compressed mechanically between the plug end and the peripheral skirt of the F-nut socket. An end cap may be included that coaxially and externally mounts the sleeve, with an internal seal seated within an end cap ring groove deforming to provide enhanced moisture sealing. Internal O-rings, seals, or the like may be combined with the foregoing for enhancing connector sealing.

Thus direct electrical and mechanical contact between the F-nut and the cable sheath is effectuated.

Thus the primary object of my invention is to promote electrical continuity within an electrical connector such as an F-connector.

Another object is to increase the grounding and shielding characteristics of an electrical connector.

More particularly, an object of my invention is to provide dependable electrical grounding connections within coaxial connectors, especially F-connectors.

Another fundamental object of the present invention is to directly electrically and mechanically interconnect the internal coaxial cable sheath with the F-connector nut.

A similar object is to provide a proper continuity in a coaxial connector, even though required torque settings have been ignored.

Another object of the present invention to provide reliable continuity between a connector and a target socket or port, even if the connector is not fully tightened.

It is another object of the present invention to provide a compressible coaxial cable connector which establishes and maintains reliable electrical interconnection between the nut and the coaxial cable sheath.

It is still another object of the present invention to provide such a coaxial connector that can be manufactured economically.

A related object is to provide a coaxial connector that replaces metallic components with plastic components while maintaining electrical and RF performance.

A further related object is to provide a coaxial connector that is lighter in weight to reduce transportation costs.

Another object of my invention is to provide a connector of the character described that establishes satisfactory EMP, EMI, and RFI shielding.

A related object is to provide a connector of the character described that establishes reliable continuity between critical parts during installation of the male connector to the various types of threaded female connections, even though applied torque may fail to meet specifications.

Another essential object is to establish a proper ground electrical path with a female receptacle even where the male connector is not fully torqued to the proper settings.

Another important object is to minimize resistive losses in a coaxial cable junction.

A still further object is to provide a connector of the character described suitable for use with demanding, large bandwidth systems approximating four GHz.

A related object is to provide an F-connector ideally adapted for home satellite systems distributing multiple, high definition television channels.

Another important object is to provide a connector of the character described that is weather proof and moisture resistant.

Another important object is to provide a compression F-connector of the character described that can be safely and properly installed without deformation of critical parts during final compression.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE PREFERRED EMBODIMENTS

Coaxial cable F-connectors are well known in the art. The basic constituents of compressible coaxial connectors are described in detail, for example, in prior U.S. Pat. No. 7,841,896 entitled "Sealed Compression Type Coaxial Cable F-Connectors", issued Nov. 30, 2010, in prior U.S. Pat. No. 7,513,795, entitled "Compression Type Coaxial Cable F-Connectors", issued Apr. 7, 2009, and in prior U.S. Pat. No. 8,371,874, entitled "Compression Type Coaxial Cable F-Connectors With Traveling Seal And Barbless Post," issued Feb. 12, 2013, which are owned equitably and/or legally by the same assignee as in the instant case. However, it will be appreciated by those with skill in the art that compressible coaxial cable connectors of various diverse other designs may be employed with the grounding adaptations described hereinafter.

Figure 1:
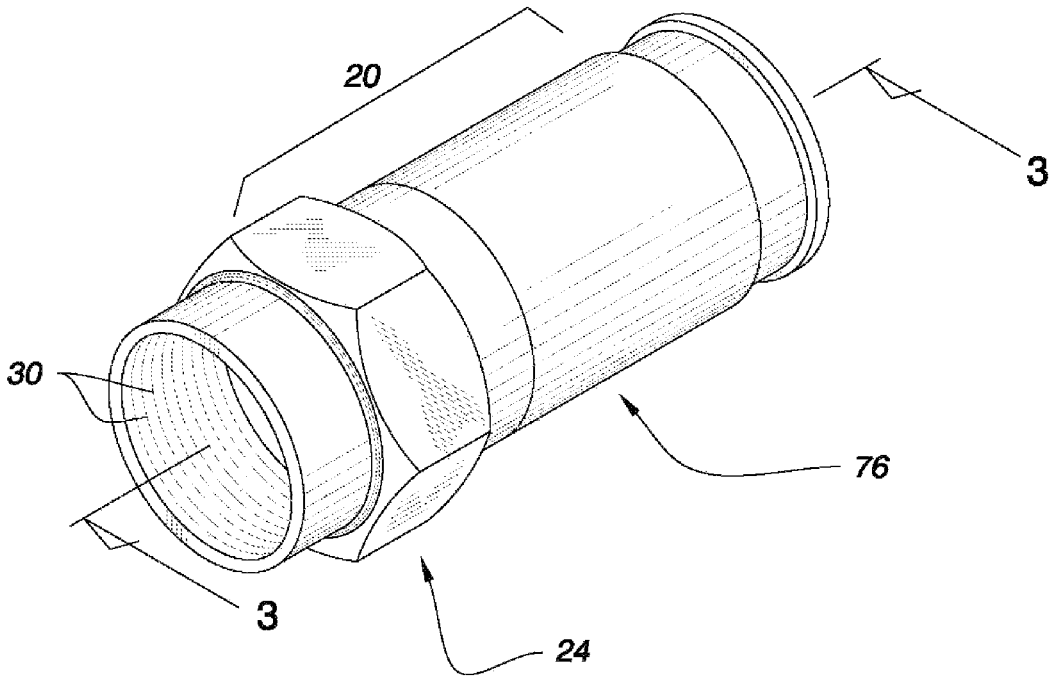
FIG. 1 is a frontal isometric view of a coaxial F-connector.
Figure 2:
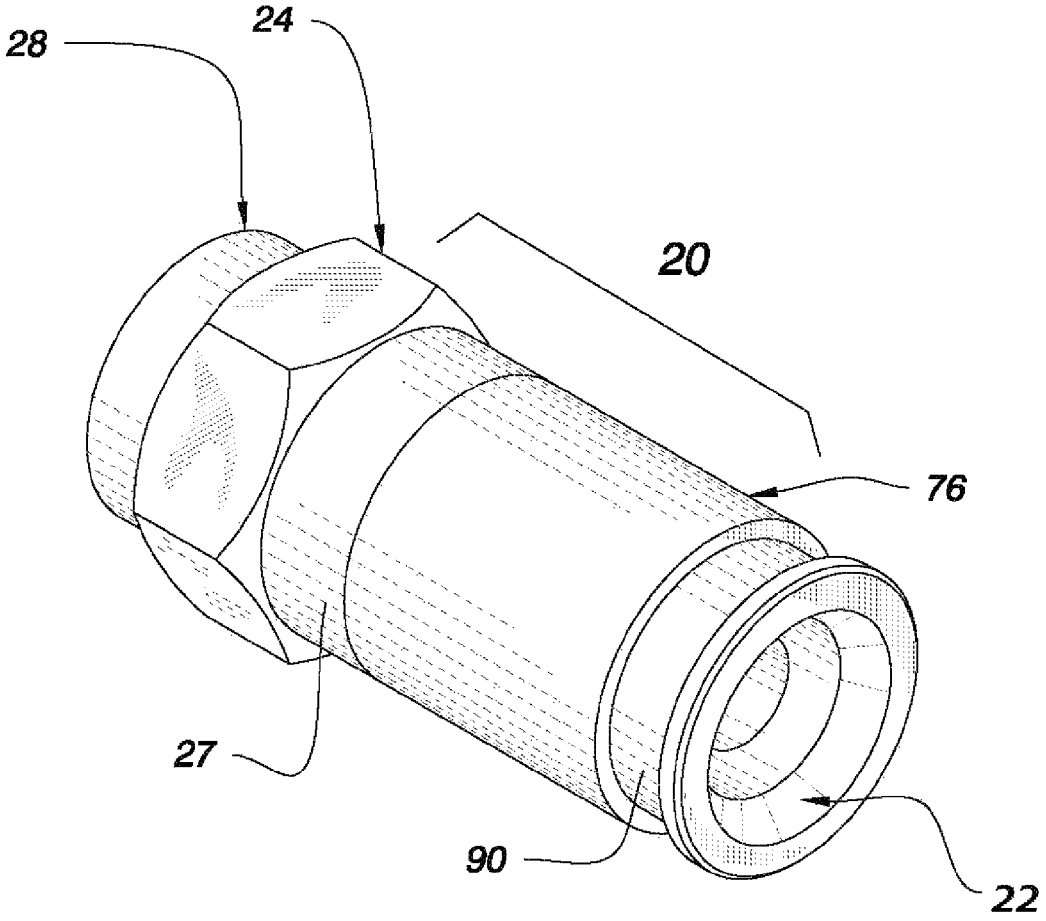
FIG. 2 is a rear isometric view of the connector of FIG. 1.
Figure 3:
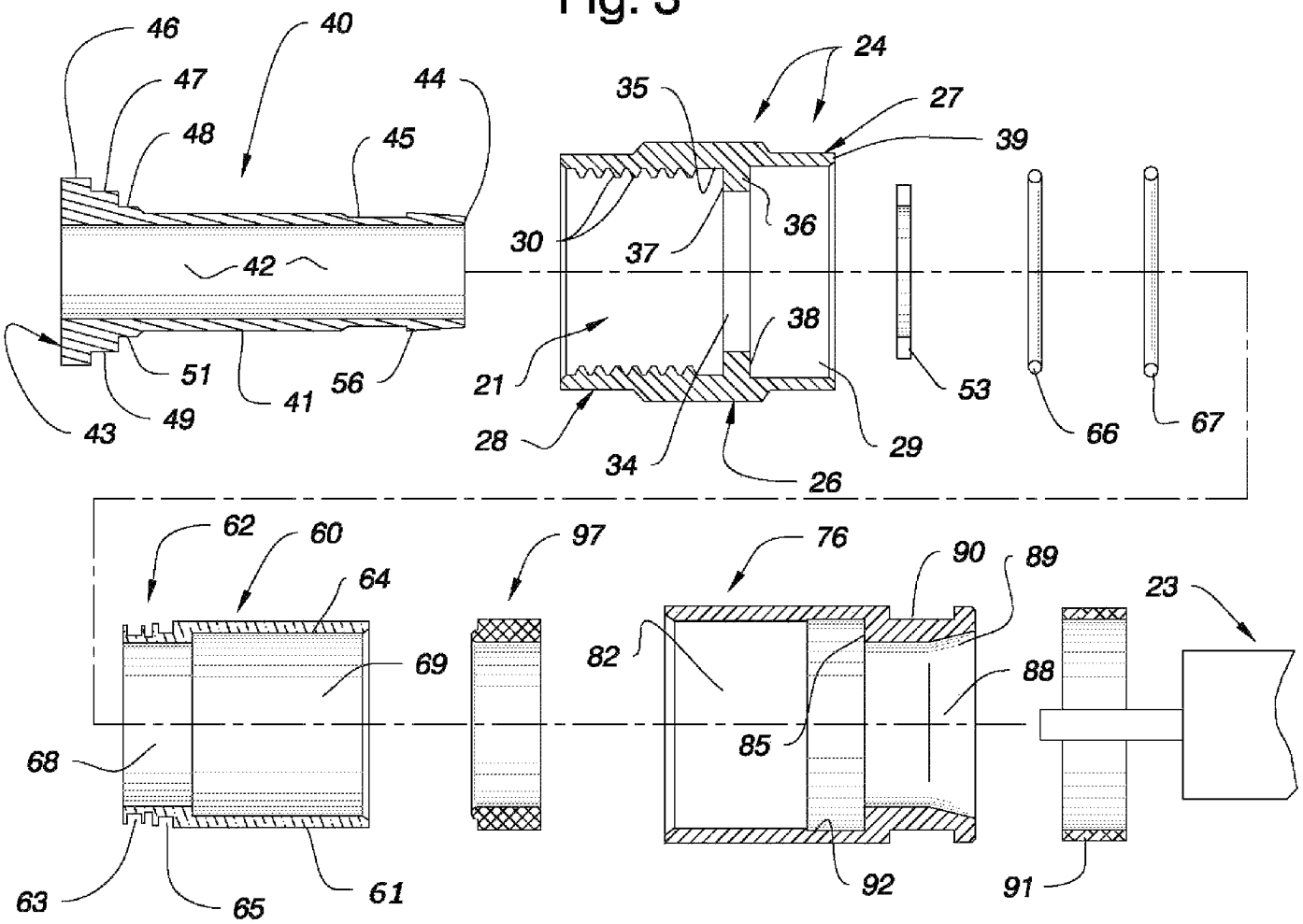
FIG. 3 is an exploded, longitudinal sectional view of the connector of FIG. 1, taken generally along line 3-3 of FIG. 1.

Referring initially to FIGS. 1-3 of the appended drawings, a coaxial F-connector constructed in accordance with an embodiment of the invention has been generally designated by the reference numeral 20. As will be recognized by those skilled in the art, connector 20 is a compressible F-connector, that is axially squeezed together longitudinally during joining to a coaxial cable. Connector 20 is adapted to be coupled to a terminal end 23 (FIG. 4C) of a properly prepared coaxial cable, which is subsequently inserted through the open bottom or rear end 22 of the connector 20. With the component parts configured and arranged as in FIG. 4C, and initially hand manipulated towards one another thereafter, a conventional compression hand tool may be employed for compression. Afterwards, the connector 20 assumes the closed configuration of FIGS. 1, 2, and 7.

Connector 20 comprises a rigid, tubular, metallic nut 24 with a conventional faceted, preferably hexagonal drive head 26 that is integral with a forwardly protruding, coaxial stem 28. Head 26 integrally supports a rear skirt 27 that concentrically defines a receptive socket 29. Nut 24 is threadably installed during installation, and hopefully it is properly torqued. Conventional, internal threads 30 (FIGS. 1, 3) are defined in the interior of stem 28 for rotatably, threadably mating with a suitably-threaded, female socket or receptacle. The open, tubular front end 21 (FIG. 3) of connector 20 is contiguous with a reduced diameter passageway 34 towards the rear of the nut, and is centered within integral ring 36, bordering larger diameter socket 29 at the back of nut 24 (FIG. 3). Circular passageway 34 concentrically borders an annular, non-threaded, internal ring groove 35 that borders internal shoulders 37 and 38 coaxially defined on opposite sides of ring 36 proximate internal nut passageway 34. There is an annular wall 39 on the end of skirt 27 at the rear of the nut 24.

An elongated, tubular post 40 coaxially passes through the nut 24. The tubular post 40 defines an elongated shank 41 with a coaxial, internal passageway 42 extending between its front 43 and rear 44. Shank 41 may or may not terminate in one or more barbs 56 formed on it for engaging coaxial cable. In some embodiments a ring groove 45 is formed in the post shank 41 proximate the post rear, near barb 56 (FIG. 3). A front, annular post flange 46 (FIG. 3) borders integral, reduced diameter flanges 47 and 48. A shoulder 49 is coaxially defined at the rear of flange 46, and a similar spaced-apart, smaller diameter shoulder 51 is coaxially defined upon the rear of post flange 47. Post 40 is preferably composed of plastic material such as polyethylene ("PE"), polyoxymethylene ("POM"), and acrylonitrile butadiene styrene ("ABS"), but may also be metallic.

Figure 4A:
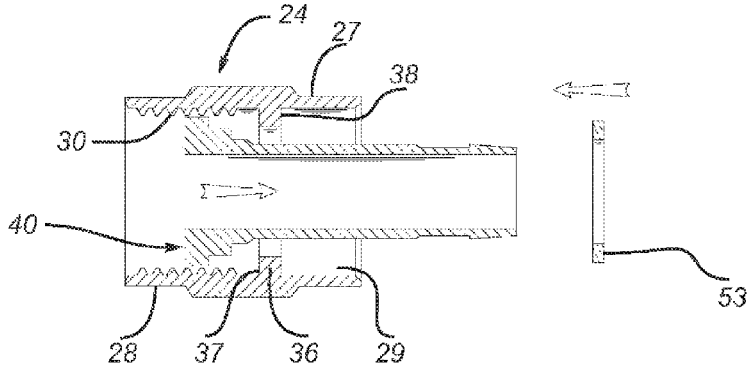
FIG. 4A is a diagrammatic, longitudinal sectional view showing the positioning of a nut and a post, prior to assembly and subsequent compression, with portions thereof broken away for brevity.

Preferably the nut 24 and the post 40 are preassembled with an assembly O-ring 53 into a discrete subassembly that can be grasped and manipulated by the installing technician. FIG. 4A shows the preassembly of the nut and the post by coaxial insertion of the post into the front end of the nut 21 until flange 46 is adjacent to shoulder of integral ring 37 causing post shoulder 49 to be axially centered within nut passageway 34. Assembly ring 53 is coaxially installed from the rear of the post 44 and fixed to post flange 48 adjacent to shoulder 38, allowing the nut to rotate freely relative to the longitudinal axis of the connector, but preventing it from being removed from the post as shown in FIG. 4C.

An elongated, hollow and tubular plastic sleeve 60 is disposed within the connector 20. Sleeve 60 comprises an elongated, rear shank 64 that is integral with a slightly reduced diameter, frontal plug portion 62. Alternatively, the entire sleeve 60 may be of a uniform diameter. The elongated, outer periphery 61 of shank 64 is preferably smooth and cylindrical. Some embodiments of the frontal plug portion 62 have a pair of spaced apart, peripheral ring grooves 63 and 65 that seat O-rings 66 and 67 respectively. Plug passageway 68 is a smaller diameter than neighboring sleeve rear passageway 69.

Figure 4B:
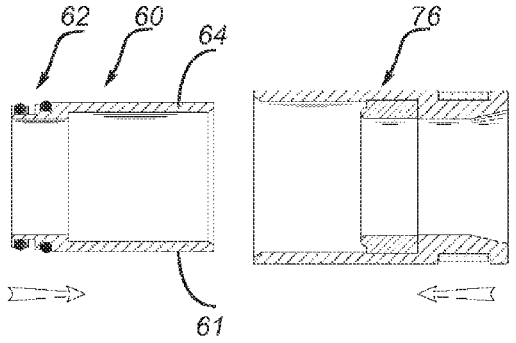
FIG. 4B is a diagrammatic, longitudinal sectional view showing the positioning of a body and an end cap, prior to assembly and subsequent compression, with portions thereof broken away for brevity.
Figure 4C:
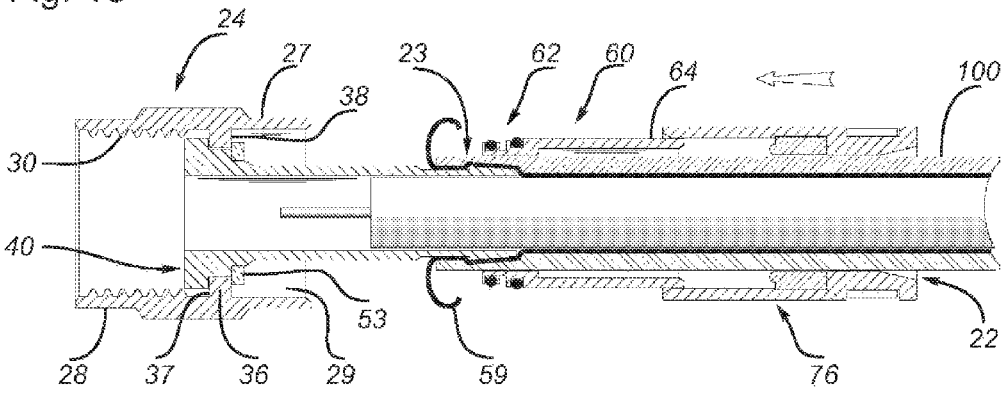
FIG. 4C is a diagrammatic, longitudinal sectional view showing the positioning of connector parts upon a prepared end of coaxial cable, prior to assembly and subsequent compression, with portions thereof broken away for brevity.
Figure 5:
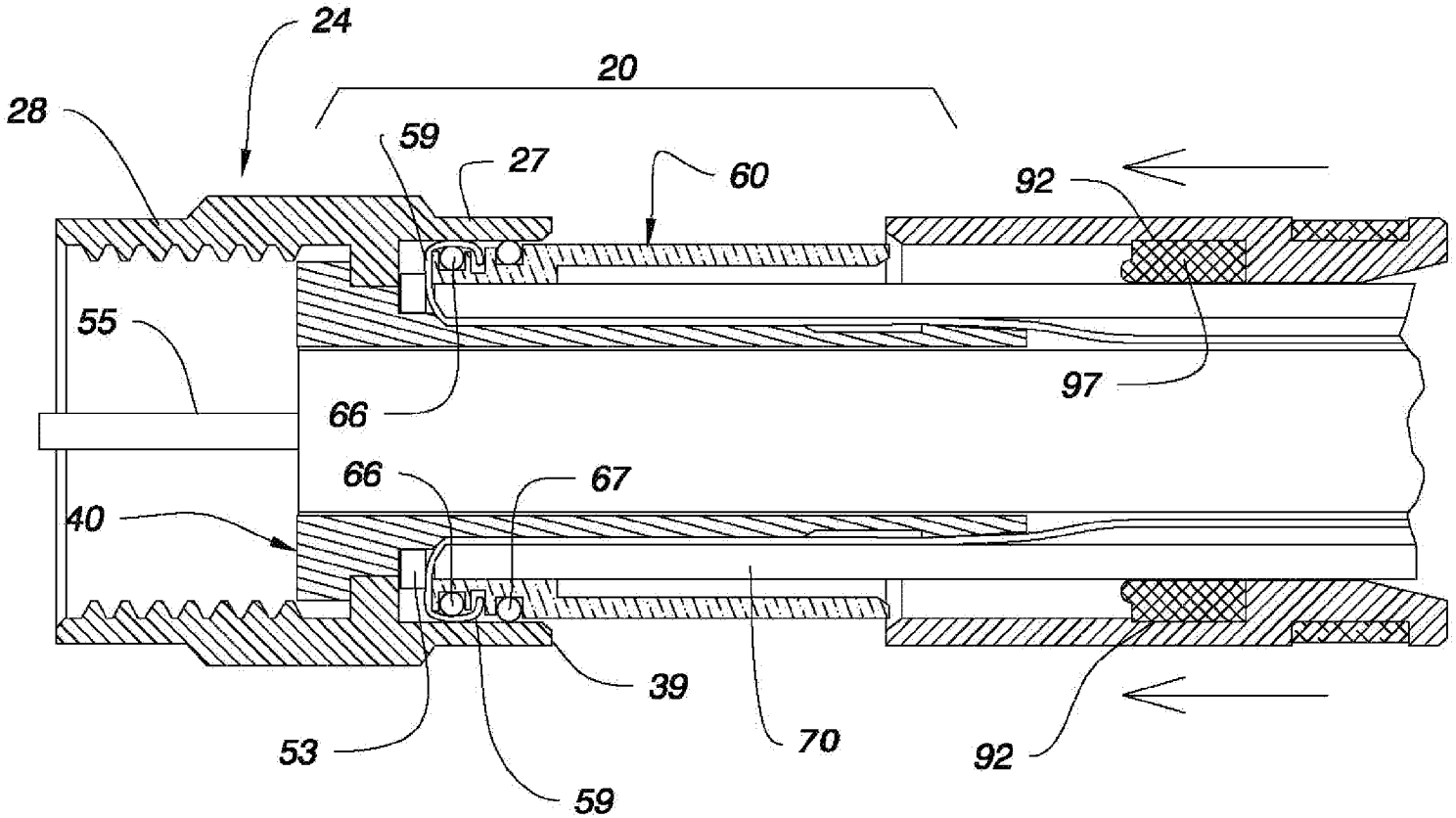
FIG. 5 is an enlarged, longitudinal sectional view of an uncompressed F-connector constructed in accordance with the invention showing the positioning of connector parts upon a properly prepared end of coaxial cable prior to assembly and subsequent compression, with portions thereof broken away for brevity.
Figure 6:
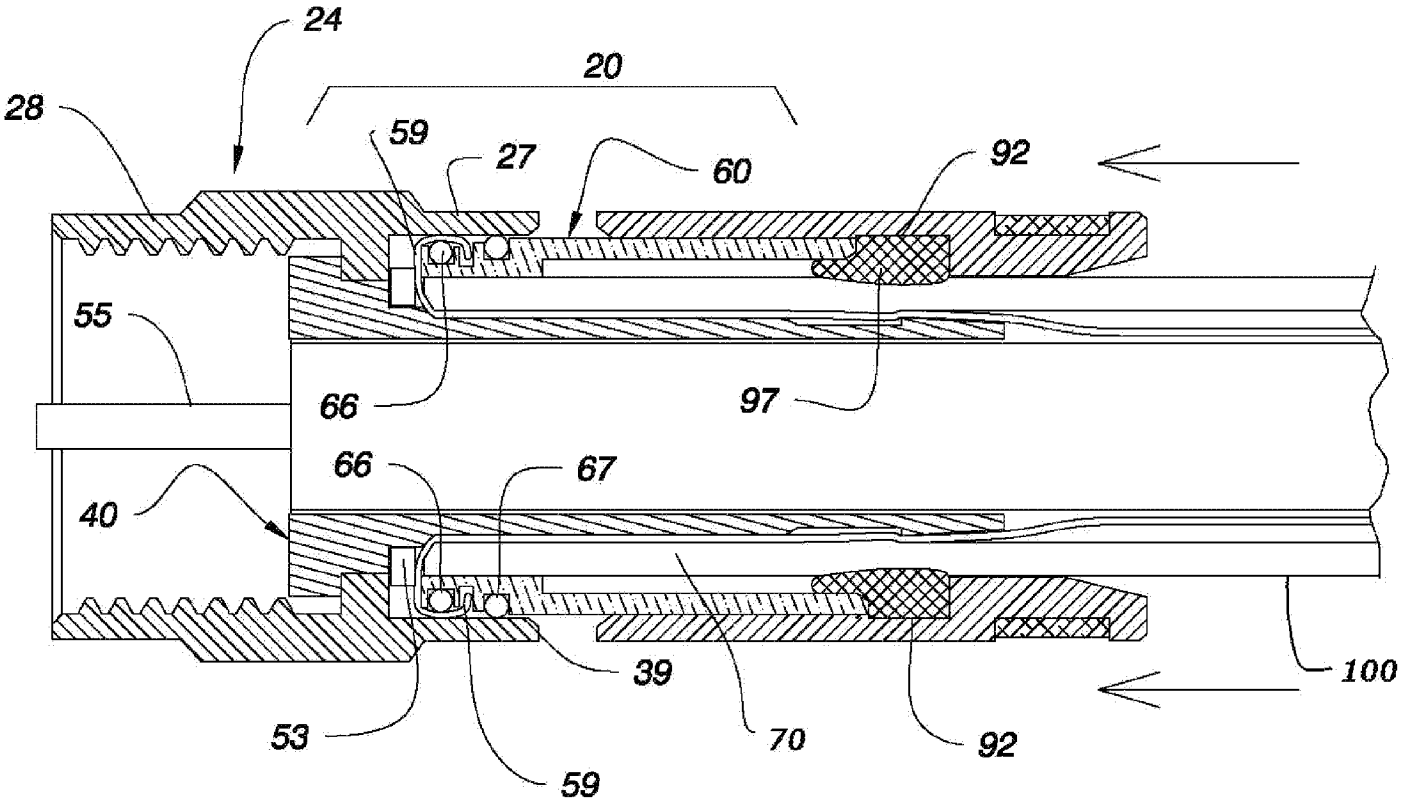
FIG. 6 is an enlarged, longitudinal sectional view of a partially compressed F-connector constructed in accordance with the invention showing the intermediate positioning of connector parts prior to full compression, with portions thereof broken away for brevity.

A rigid, preferably metallic end cap 76 may be included in some embodiments and is preferably preassembled coaxially upon outer periphery 61 of the sleeve rear shank 64 as shown in FIGS. 4B and 4C. The end cap frictionally grips the shank outer periphery to maintain the union with the sleeve until assembly and compression of the connector. An outer ring groove 90 at the cap seats an optional, external band 91 that can be added to establish a tactile "feel" for the installer. Band 91 can also enhance the aesthetic appearance of the connector, and it can facilitate color coding.

In assembly, (FIGS. 3, 4C, and 5-7) the sleeve 60 and end cap 76 union will coaxially engage the cable 100. The reduced diameter passageway 88 is sized to slidably receive coaxial cable, which is inserted through the flared opening 89. Plug passageway 68 will tightly, coaxially contact the normally black outermost layer 70 of the coax 100. However, the larger diameter sleeve passageway 69 within sleeve shank 64 can establish an annular void 71 upon assembly, between coax outer layer 70 and sleeve shank 64.

The rear, tapered end 44 of post shank 41 penetrates the prepared end 23 (i.e., FIG. 4C) of the coaxial cable, such that the inner, usually copper center conductor 55 (FIG. 5) of the cable coaxially penetrates passageway 42 and enters the front 21 of the nut 24. As recognized by those skilled in the art, the braided shield of the coaxial cable prepared end will be substantially positioned around the exterior of post shank 41 when the connector is compressed. Electrical contact, or continuity between the coaxial cable sheath, the post 40, and the nut 24 is a normal design requirement. However, it is preferred that, to enhance the likelihood of establishing reliable continuity, the connector sleeve 60 has been designed to engage the F-nut socket 29 for grounding. Sleeve 60 will slidably engage F-nut 24, with plug portion 62 seating within socket 29 upon compression. To promote continuity, the coax braid portions 59 will be looped around the sleeve plug portion 62 over at least one O-ring 66 (i.e., FIG. 5). The sleeve 60 forces the cable prepared end sheath portions 59 (i.e., FIG. 5) interiorly against skirt 27 and captivates portions 59 within socket 29. In this manner grounding or continuity is enhanced by the folded terminal portions 59 of the coax sheath or braid that are captivated within the socket 29 and sandwiched into direct contact with the F-nut 24 by sleeve plug portion 62.

Figure 7:
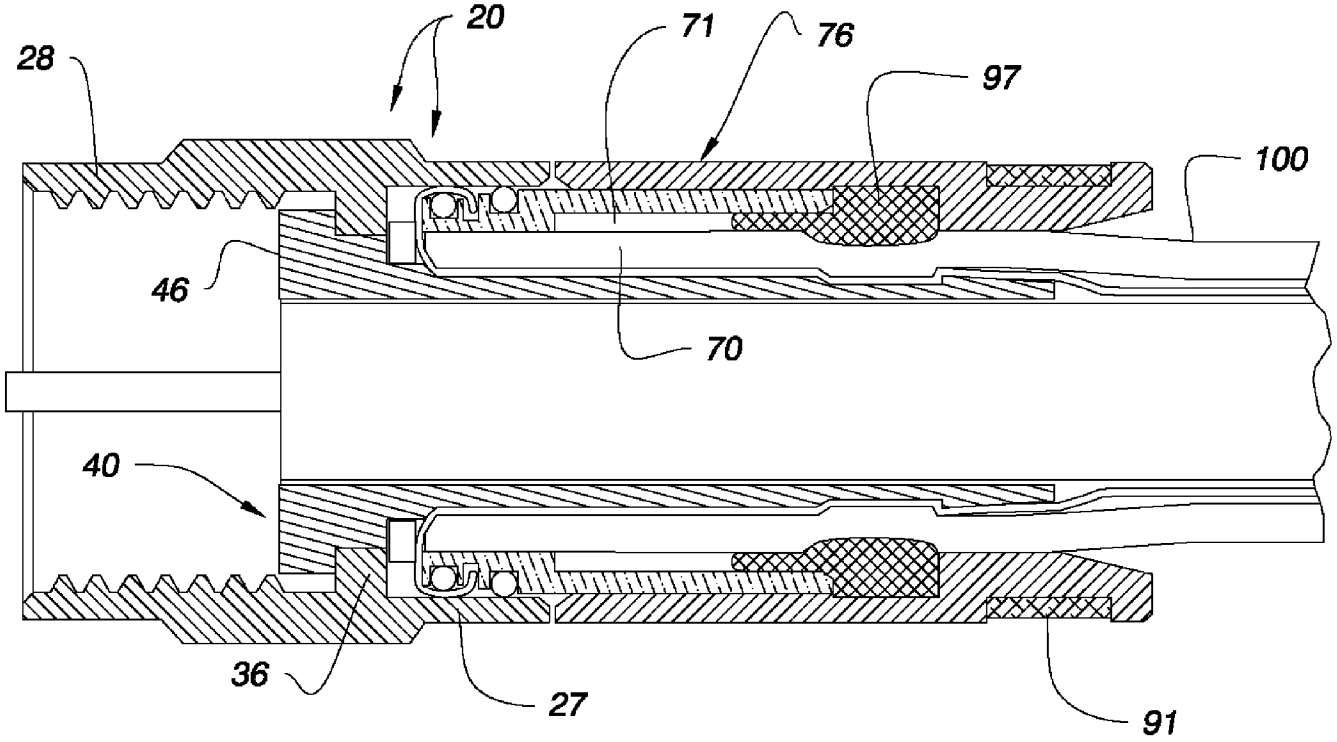
FIG. 7 is an enlarged, longitudinal sectional view of a fully compressed F-connector constructed in accordance with the invention, showing the end positions of connector parts at full compression, with portions thereof broken away for brevity; and, FIG. 8 is an enlarged, longitudinal sectional view of a fully compressed F-connector constructed in accordance with another embodiment of the invention, showing the end positions of connector parts at full compression, with portions thereof broken away for brevity.

The end cap 76 is pressed onto sleeve 60 to complete assembly. The rigid, end cap 76 smoothly, frictionally grips outer periphery 61, with maximum travel or displacement limited by F-nut skirt 27 (i.e., FIG. 5). In other words, when the end cap 76 is compressed onto the sleeve 60, and the connector 20 assumes a closed position (i.e., FIG. 7), annular rear wall 39 on the F-nut will limit axial deflection and travel of the end cap 76. When the sleeve 60 and the cap 76 are compressed together, sleeve travel is limited within cap passageway 82 by contact with an annular, resilient band 97 seated within an internal ring groove 92 within cap 76 proximate shoulder 85. The preferred dual diameter band 97 is explained in detail in U.S. Pat. No. 7,841,896 and in U.S. Pat. No. 8,371,874. Sealing band 97 is seen in its rest or normal static state in FIG. 5. During connector compression however, a traveling phenomena occurs, resulting in substantial seal distortion, and the configuration of FIG. 7 is reached. It will also be noted the band 97 urges at least a portion of the coax beneath it towards the peripheral ring groove 45 defined within the shank of post 40.

Figure 8:
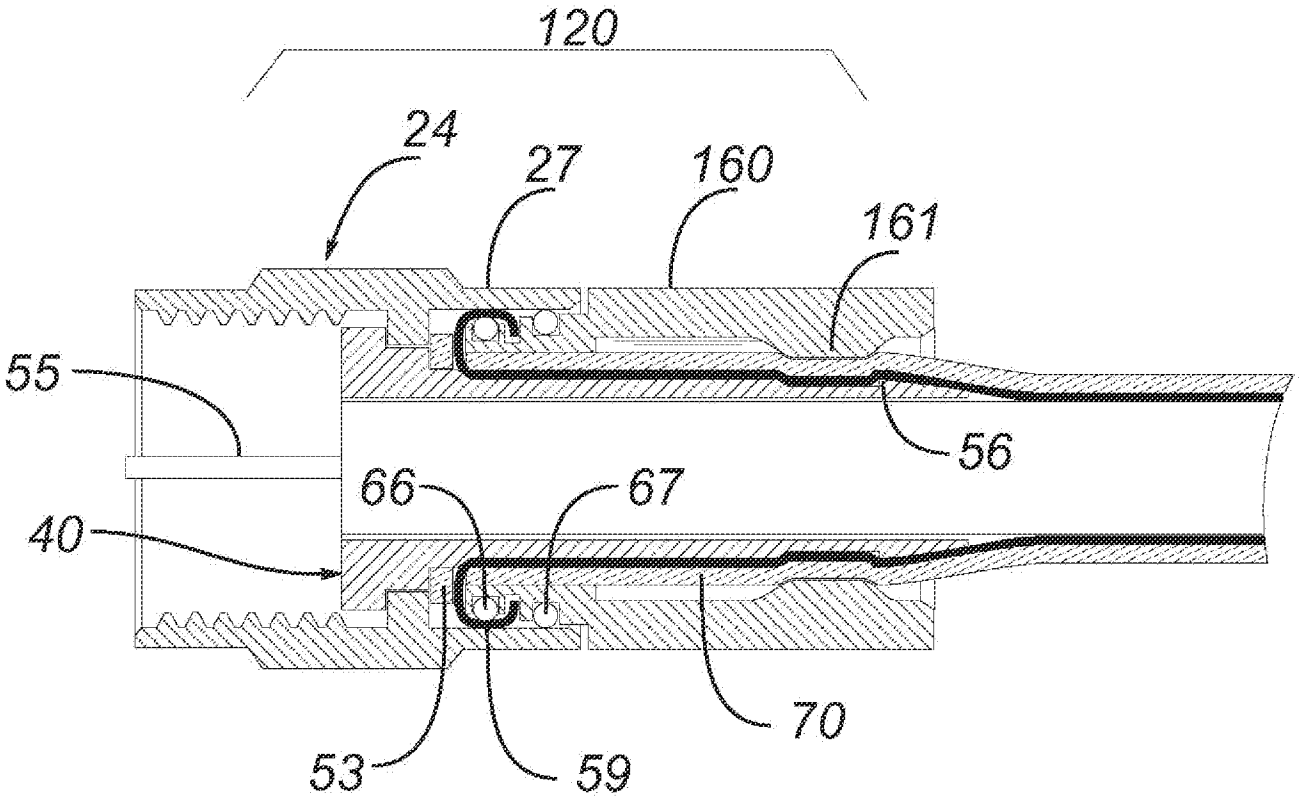

FIG. 8 shows an alternative embodiment of the invention connector 120 after compression. In this embodiment end cap 76 is not present, and instead sleeve 160 is present and has a reduced diameter rear section 161 that cooperates with post barbs 56 to hold the coaxial cable in place in the connector upon compression.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A compressible coaxial connector for coaxial cable, the connector comprising:

a nut is configured to threadably fasten the connector, the nut comprising a rear skirt forming a socket;

an elongated, hollow post comprising a portion that internally abuts the nut and a shank portion that engages the cable;

a hollow, tubular sleeve coaxially disposed over said post shank, the sleeve comprising a plug portion adapted to be inserted within said socket;

wherein at least a portion of the coaxial cable sheath is forced by said plug portion into electrical and mechanical contact with said nut; and, an end cap is configured to be coupled to said connector.

2. The connector as defined in claim 1 wherein the portion of the coaxial cable sheath is folded over said plug portion.

3. The connector as defined in claim 2 wherein the plug portion comprises at least one O-ring contacting the coaxial cable sheath and forcing the sheath into contact with said nut.

4. A connector for coaxial cable, the connector comprising:

a nut having a front end is configured to mate with a female port and a rear end skirt forming a socket;

a post having a front flange and an elongated rear shank;

a body sleeve having a front portion, the sleeve coaxially disposed over the post and the front portion coaxially disposed in the socket; and, wherein an outer conductor of the cable is forced into contact with the socket by the sleeve front.

5. The connector as defined in claim 4 wherein the only electrical path from the outer conductor of the cable to an outer conductor of the female port is only through the nut.

6. The connector as defined in claim 4 comprising an assembly ring, wherein the ring rotably fixes the nut to the post.

7. The connector as defined in claim 4 wherein the sleeve has an annular groove and an O-ring seated in and extending from the groove to force the outer conductor into contact with the socket.

8. The connector as defined in claim 7 wherein the sleeve has a second annular groove and a second o-ring for environmental sealing between the sleeve and the nut.

9. The connector as defined in claim 4 having an end cap coaxially disposed over the sleeve.

10. A coaxial cable connector, the connector comprising:

a conductive male fastener is configured for connection to a female coaxial port, having a rear skirt with an annular inner surface;

a nonconductive cable mating sleeve coaxially disposed within the fastener;

a nonconductive outer sleeve coaxially disposed over the mating sleeve, having a reduced diameter front portion adjacent to the skirt inner surface; and, wherein a coaxial cable braid is held into electrical and mechanical contact with the skirt inner surface by the front portion of the outer sleeve.

11. The connector of claim 10 wherein the fastener is rotably coupled to the mating sleeve by an assembly O-ring.

12. The connector of claim 11 wherein the assembly O-ring has a square cross-section.

13. The connector of claim 10 wherein the outer sleeve comprises an environment seal.

14. The connector of claim 10 wherein the mating sleeve comprises a barbed end, and the outer sleeve comprises a reduced diameter inner section coaxially located adjacent to the barbed end to prevent movement of the coaxial cable when the connector is compressed.

15. The connector of claim 10 comprising a rear shell slidably coupled to the outer sleeve.

* * * * *